United States Patent [19]

Gibson et al.

[11] Patent Number: 4,897,332

[45] Date of Patent: Jan. 30, 1990

[54] CHARGE CONTROL AGENT COMBINATION OF LECITHIN AND PYRROLIDONE POLYMER FOR LIQUID TONER AND METHODS OF USE

[75] Inventors: George A. Gibson, Vandalia; Ray H. Luebbe, Jr., Centerville, both of Ohio

[73] Assignee: AM International, Inc., Chicago, Ill.

[21] Appl. No.: 253,788

[22] Filed: Oct. 5, 1988

[51] Int. Cl.[4] ..... G03G 9/12

[52] U.S. Cl. ..... 430/115; 430/904

[58] Field of Search ..... 430/115, 904

[56] References Cited

U.S. PATENT DOCUMENTS 3,985,663 10/1976 Lu et al. ..... 430/115

4,762,764 8/1988 Ng et al. ..... 430/115

*Primary Examiner*—J. David Welsh

*Attorney, Agent, or Firm*—Biebel, French & Nauman

[57] ABSTRACT

Improved charge control agent for electrophotographic liquid toners comprising a mixture of lecithin and an alkylated poly-N-vinyl pyrrolidone polymer is disclosed. Methods include applying liquid toners comprising such charge control agent mixture to an electroconductive substrate that has been electrostatically charged in the image areas thereof.

14 Claims, No Drawings

CHARGE CONTROL AGENT COMBINATION OF LECITHIN AND PYRROLIDONE POLYMER FOR LIQUID TONER AND METHODS OF USE

FIELD OF THE INVENTION

The present invention pertains to liquid toner dispersions of the type used in electrophotography. More specifically, the invention pertains to an improved liquid toner dispersion whose conductivity is more uniform throughout usage despite repetitive application of electric fields thereto.

BACKGROUND OF THE INVENTION

Liquid toner dispersions for electrophotography are generally prepared by dispersing pigments or dyes, and natural or synthetic resins in a highly insulating, low dielectric constant carrier liquid. Charge control agents are added to aid in charging the pigment and dye particles to the requisite polarity for proper image formation on the desired substrate.

Images are photoelectrically formed on a photoconductive layer mounted on a conductive base. The layer is sensitized by electrical charging whereby electrical charges are uniformly distributed over the surface. The photoconductive layer is then exposed by projecting an image over the surface or alternatively by writing an image on the surface with a laser or L.E.D. The electrical charges on the photoconductive layer are conducted away from the areas exposed to light, with an electrostatic charge remaining in the image area. Charged pigment and/or dye particles from the liquid toner solution contact and adhere to the image areas of the plate. The image is then transferred to the desired substrate such as a carrier sheet.

One deficiency of some charge control agents is that after they have been exposed to an electric field, their conductivity can become transiently depressed. That is, upon repeated exposure to the electric field of the photoconductive layer, the ability of the charge control agent to maintain a uniform polarity diminishes over time. This is especially true in high speed electrophotographic processes wherein images must be transferred to sheets of paper running at high speed such as 100–1000 feet/min. or greater. In such systems, failure of the liquid toner charge control agents to maintain toner polarity within certain closely controlled ranges results in poor print quality. Additionally, such problems can also adversely affect mechanisms designed to feed or control toner compositions that are in some manner dependent upon toner conductivity.

Accordingly, an object of the invention is to provide a liquid toner composition having improved charge control attributes. An even more specific object is to provide improved liquid toner compositions that are capable of maintaining their polarity within a relatively narrow, uniform range even during high speed electrophotographic processes such as those mentioned hereinabove.

PRIOR ART

In U.S. Pat. No. 4,618,557 (Dan et al) liquid developers for electrostatic photography are disclosed. Polarity controlling agents including polymers which may contain a metal soap, lecithin, linseed oil, a higher fatty acid, vinyl-pyrrolidone, etc., are disclosed. Similarly, U.S. Pat. No. 4,497,886 (Herman et al) teach a charge controlling treatment of a copolymer of N-vinyl-2-pyrrolidone and a methacrylic acid ester and a poly-N-vinyl 2-pyrrolidone that has been alkylated with an alpha-olephin.

Other patents of general interest include: U.S. Pat. Nos. 4,374,918 (Veillette) disclosing charge control agents comprising(meth)acrylic acid ester/vinyl pyrrolidone repeat units; and 4,243,736 (Hermann) disclosed similar copolymers. U.S. Pat. Nos. 3,900,412 (Kosel); 3,991,226 (Kosel); and 4,707,429 (Trout) may also be noted as being of general information.

SUMMARY OF THE INVENTION

I have found that a combination of lecithin and alkylated N-vinyl pyrrolidone polymer, both soluble in the carrier liquid, provides an improved charge control agent in liquid toners. This combination results in improved maintenance of a constant polarity or charge in the liquid toner even after repeated application of electric fields thereto such as is the case in high speed electrophotographic printing operations. The use of lecithin and an alkylated N-vinyl pyrrolidone polymer, singly, as charge control agents for liquid toners, is known. However, quite surprisingly, the combination of the two provides unexpected results in the ability of the charge control agent to maintain uniformity in toner charge in high speed electrophotographic printing operations.

DETAILED DESCRIPTION OF THE PREFERRED EMBODIMENT

As a carrier liquid for the liquid toner dispersions of the invention, those having an electric resistance of at least $10^9\Omega$ cm and a dielectric constant of not more than 3.5 are useful. Exemplary carrier liquids include straight-chain or branched-chain aliphatic hydrocarbons and the halogen substitution products thereof. Examples of these materials include octane, isooctane, decane, isodecane, decalin, nonane, dodecane, isododecane, etc. Such materials are sold commercially by Exxon Co. under the trademarks: Isopar®-G, Isopar®-H, Isopar®-K, Isopar®-L, Isopar®-V. These particular hydrocarbon liquids are narrow cuts of isoparaffinic hydrocarbon fractions with extremely high levels of purity. High purity paraffinic liquids such as the Norpar series of products sold by Exxon may also be used. These materials may be used singly or in combination. It is presently preferred to use Isopar®-H.

The pigments that are to be used are well known. For instance, carbon blacks such as channel black, furnace black or lamp black may be employed in the preparation of black developers. One particularly preferred carbon black is "Mogul L" from Cabot. Organic pigments, such as Phthalocyanine Blue (C.I. No. 74 160), Phthalocyanine Green (C.I. No. 74 260 or 42 040), Sky Blue (C.I. No. 42 780), Rhodamine (C.I. No. 45 170), Malachite Green (C.I. No. 42 000), Methyl Violet (C.I. 42 535), Peacock Blue (C.I. No. 42 090), Naphthol Green B (C.I. No. 10 020), Naphthol Green Y (C.I. No. 10 006), Naphthol Yellow S (C.I. No. 10 316), Permanent Red 4R (C.I. No. 12 370), Brilliant Fast Pink (C.I. No. 15 865 or 16 105), Hansa Yellow (C.I. No. 11 725), Benzidine Yellow (C.I. No. 21 100), Lithol Red (C.I. No. 15 630), Lake Red D (C.I. No. 15 500), Brilliant Carmine 6B (C.I. No. 15 850), Permanent Red F5R (C.I. No. 12 335) and Pigment Pink 3B (C.I. No. 16 015), are also suitable. Inorganic pigments, for example Berlin Blue (C.I. No. Pigment Blue 27), are also useful.

Additionally, magnetic metal oxides such as iron oxide and iron oxide/magnetites may be mentioned.

As is known in the art, binders are used in liquid toner dispersions to fix the pigment particles to the desired support medium such as paper, plastic film, etc., and to aid in the pigment charge. These binders may comprise thermoplastic resins or polymers such as ethylene vinyl acetate (EVA) copolymers (Elvax® resins, DuPont), varied copolymers of ethylene and an $\alpha$, $\beta$-ethylenically unsaturated acid including (meth) acrylic acid and lower alkyl ($C_1$–$C_5$) esters thereof. Copolymers of ethylene and polystyrene, and isostatic polypropylene (crystalline) may also be mentioned. Both natural and synthetic wax materials may also be used. The binders are insoluble in the carrier liquid at room temperature.

The novel charge control agent of the present invention comprises both lecithin and an alkylated N-vinyl pyrrolidone polymer in a weight ratio of from 1:9 to 9:1 lecithin:polymer. A preferred weight ratio range is from 1:1 (lecithin:polymer) to 1:9 with an especially preferred range being from about 3:7 to 1:9 lecithin:-polymer.

Lecithin extract (L-$\alpha$-phosphatidyl-choline) is readily available from many sources and can be obtained from bovine brain, egg yolk, soybean, etc. These products may, for instance, be purchased from Sigma Chemical, St. Louis, Mo. At present, it is preferred to use soybean lecithin.

The alkylated N-vinyl pyrrolidone polymers may be prepared by reacting poly-N-vinyl pyrrolidone with an olefin in the presence of organic peroxide catalysts at elevated temperatures. Details of the reaction may be gleaned from U.S. Pat. No. 3,417,054 (Merijan et al), the disclosure of which is hereby incorporated by reference herein. The $\alpha$-olefin will preferably have from about 12–20 carbon atoms. For example, doecene-1, tetradecene-1, hexadecene-1, heptadecene-1, octadecene-1, nonadecene-1, and eicosene-1, may be mentioned. Further, low molecular weight polybutenes may also be used in the alkylation step. It is also possible for the various olefins to be reacted in a mixture. One particularly advantageous and in fact preferred alkylated poly-N-vinyl pyrrolidone is commercially available from G.A.F. under the trademark "Ganex V-216". It is reputedly poly(vinyl pyrrolidone/1-hexadecene) homopolymer having a molecular weight of about 7300. Molecular weight is not critical as long as the resulting polymer is soluble in the carrier liquid.

| Preferred compositions include | |
|---|---|
| carrier liquid | |
| non-volatiles (solids) | 0.5–20 wt. % (based on total weight of carrier liquid) - preferred 2–4% |
| color imparting particles | |
| pigments or dyes | 0–50 wt. % (based on total weight solids) |
| binder (resin, polymer, or wax) | 30–99 wt. % (based on total weight solids) |
| charge control agents | $1 \times 10^{-4}$ – 20% (based on total weight of carrier liquid) |

In use, the liquid toner dispersions of the invention are applied to an electrostatically charged substrate in the image areas thereof. The liquid toner dispersions are especially well adapted for use in high speed electrophotographic printing operations wherein the paper, to which image transfer from the substrate is made, may travel at speeds of from 100–1000 feet/min., preferably from 200 feet/min. to 400 feet/min. However, the invention is not solely adapted for use in such high speed printing operations and can also be successfully used for normal office electrostatic copiers such as the type described in U.S. Pat. No. 4,325,627 (Swidler et al).

The invention will now be further described with reference to a number of specific examples which are to be regarded solely as illustrative, and not as restricting the scope of the invention.

EXAMPLES

In order to assess the efficacy of the charge control agents in maintaining the desired toner conductivity a cell is provided with a $5 \times 10_{-4}$ wt. % solution of the desired charge control agent in isopar-H admitted to the cell. Four consecutive 1500 volt pulses, each of 8 second duration, are applied to the cell with 35 second "rest" intervals between the pulses. After the last of these pulses a 95 second "rest" interval is observed followed by one additional 8 second pulse. The integrated current passing through the cell is recorded for each pulse and the relative value of the measured integrated current being plotted against time. The current observed for the first pulse is taken to be 100%, with the currents measured for subsequent pulses being expressed as a percentage of the first pulse value.

Results of these examples appear in the following Table.

TABLE I

Relative Intensities of Charge Control Agents

| Example | Components | Relative Intensities Pulse #1, | 2, | 3, | 4, | 5 |
|---|---|---|---|---|---|---|
| 1 | 100% lecithin | 100 | 46 | 21 | 11 | 8 |
| 2 | 100% Ganex V-216* | 100 | 40 | 0 | 0 | 40 |
| 3 | Ganex V-216/lecithin 1:9 ratio (weight) | 100 | 21 | 7 | 7 | 9 |
| 4 | Ganex V-216/lecithin 3:7 ratio (weight) | 100 | 38 | 18 | 9 | 19 |
| 5 | Ganex V-216/lecithin 1:1 ratio (weight) | 100 | 51 | 25 | 21 | 38 |
| 6 | Ganex V-216/lecithin 7:3 ratio (weight) | 100 | 82 | 66 | 59 | 92 |
| 7 | Ganex V-216/lecithin** 9:1 ratio (weight) | 100 | 98 | 96 | 97 | 99 |

DISCUSSION

In accordance with the above Table, it can be seen that the conductivity of the combined lecithin/Ganex V-216 charge control agent samples is improved when compared to either lecithin or Ganex V-216, singly, in regard to the maintenance of a more uniform current in the solution over time. This fact is significant in that, as noted above, the problem commonly encountered in the field of high speed electrophotographic printing is that charge control agents, after exposure to an electric field, become transiently depressed.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

I claim:

1. Liquid toner composition for electrophotography comprising a dispersion including a carrier liquid having an electric resistance of at least $10^9\Omega$ cm. and a dielectric constant of not more than 3.5, a pigment or dye, a binder material selected from the group of resins, polymer binders and waxes wherein said binder is insoluble in said carrier liquid at room temperature, and a charge control agent, said charge control agent comprising lecithin and an alkylated N-vinyl pyrrolidone polymer, both said lecithin and said N-vinyl pyrrolidone polymer being soluble in said carrier liquid.

2. Liquid toner composition as recited in claim 1 wherein said N-vinyl pyrrolidone polymer comprises a $C_{12}$–$C_{20}$ alkyl N-vinyl pyrrolidone polymer.

3. Liquid toner composition as recited in claim 1 wherein the non-volatile components are present in an amount of about 0.5–20 wt. % based on the total weight of said carrier liquid, said binder being present in an amount of from 30–99 wt. % based upon the total weight of said non-volatile components, said pigment or dye being present in an amount of from trace-50 wt. % based on the weight of said non-volatile components and wherein said charge control agent is present in an amount of from about $1\times10^{-4}$-20 wt. % based upon the weight of said carrier liquid.

4. Liquid toner composition as recited in claim 1 wherein the weight ratio of lecithin:alkylated N-vinyl pyrrolidone polymer is from about 1:9 to 9:1.

5. Liquid toner composition as recited in claim 4 wherein the weight ratio of lecithin:alkylated N-vinyl pyrrolidone polymer is from about 3:7 to 1:9.

6. Liquid toner as recited in claim 1 wherein said carrier liquid comprises an isoparaffinic hydrocarbon fraction.

7. Liquid toner as recited in claim 4 wherein said alkylated N-vinyl pyrrolidone polymer comprises poly(vinyl pyrrolidone/1-hexadecene) homopolymer.

8. In a method of creating an image by applying an electrostatic charge to the image area of a substrate, the improvement comprising thereafter applying to said substrate a liquid toner composition comprising (i) a carrier liquid having an electric resistance of at least $10^9\Omega$ cm. and a dielectric constant of not more than 3.5, (ii) a color imparting pigment or dye, (iii) a binder material selected from the group consisting of resins, polymer binders, and waxes, said binder being insoluble in said carrier liquid at room temperature, and (iv) a charge control agent comprising lecithin and an alkylated N-vinyl pyrrolidone polymer, both said lecithin and said polymer being soluble in said carrier liquid.

9. Method as recited in claim 8 wherein said polymer comprises a $C_{12}$–$C_{20}$ alkyl N-vinyl pyrrolidone polymer.

10. Method as recited in claim 8 wherein the non-volatile components of said liquid toner composition are present in an amount of about 0.5–20 wt. % based on the total weight of said carrier liquid, said binder being present in an amount of from 30–99 wt. % based upon the total weight of said non-volatile components, said pigment or dye being present in an amount of from trace-50 wt. % based on the weight of said non-volatile components and wherein said charge control agent is present in an amount of from about $1\times10^{4}$-20 wt. % based upon the weight of said carrier liquid.

11. Method as recited in claim 8 wherein the weight ratio of lecithin:alkylated N-vinyl pyrrolidone polymer is from about 1:9 to 9:1.

12. Method as recited in claim 11 wherein the weight ratio of lecithin:alkylated N-vinyl pyrrolidone polymer is from about 3:7 to 1:9.

13. Method as recited in claim 12 wherein said carrier liquid comprises an isoparaffinic hydrocarbon fraction.

14. Method as recited in claim 8 wherein said alkylated N-vinyl pyrrolidone polymer comprises poly(vinyl pyrrolidone/1-hexadecene) homopolymer.

* * * * *